US006488308B1

(12) United States Patent
Clausing

(10) Patent No.: US 6,488,308 B1
(45) Date of Patent: Dec. 3, 2002

(54) WINTER SPORTS DEVICE

(75) Inventor: Walter Clausing, St. Moritz (CH)

(73) Assignee: Crownvale Consultants Limited, Dublin (IE)

( * ) Notice: Subject to any disclaimer, the term of this patent is extended or adjusted under 35 U.S.C. 154(b) by 0 days.

(21) Appl. No.: 09/635,689

(22) Filed: Aug. 10, 2000

(30) Foreign Application Priority Data

Apr. 20, 2000 (DE) ..... 100 19 655

(51) Int. Cl.[7] ..... A63C 5/02

(52) U.S. Cl. ..... 280/602; 280/603; 280/11.16; 280/14.21

(58) Field of Search ..... 280/14.21, 845, 280/601, 602, 603, 609, 11.16, 11.12, 18, 28, 14.1, 20, 818, 22, 28.14; 441/65

(56) References Cited

U.S. PATENT DOCUMENTS 4,537,417 A * 8/1985 Hirnbock et al. ..... 280/602
5,301,965 A * 4/1994 Floreani ..... 280/600
5,551,728 A * 9/1996 Barthel et al. ..... 280/818
5,865,446 A * 2/1999 Kobylenski et al. ..... 280/14.2
6,053,513 A * 4/2000 Dickinson ..... 280/14.2
6,131,939 A * 10/2000 Fels ..... 280/601

FOREIGN PATENT DOCUMENTS

DE 19703773 A * 8/1998 ..... 280/845

* cited by examiner

*Primary Examiner*—Brian L. Johnson
*Assistant Examiner*—Jeff Restifo
(74) *Attorney, Agent, or Firm*—Crowell & Moring LLP

(57) ABSTRACT

An item of winter sport equipment such as a ski including at least one sliding runner whose width or waisting can be at least in part varied. The variation in width and/or waisting of the sliding runner may be effected by the sliding runner having a plurality of individual parts whose relative positions are variable as by inward and outward displacement or pivotal adjustment.

28 Claims, 7 Drawing Sheets

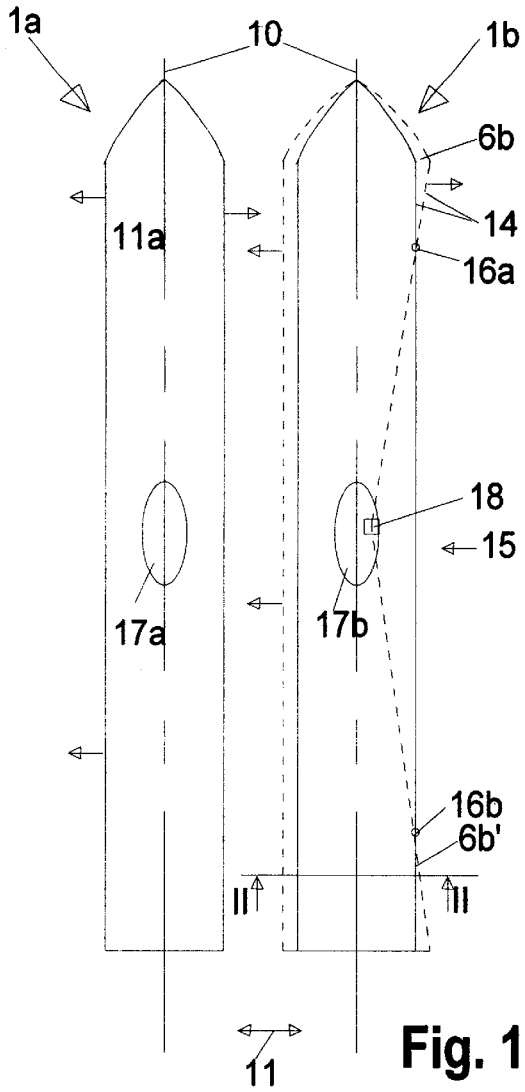
Fig. 1a
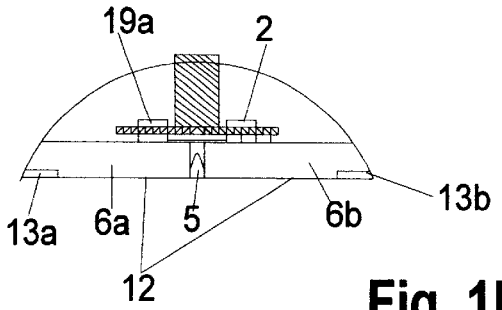
Fig. 1b
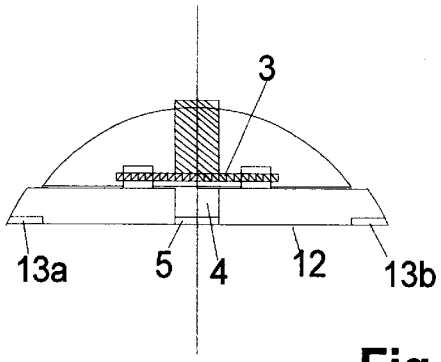
Fig. 1c
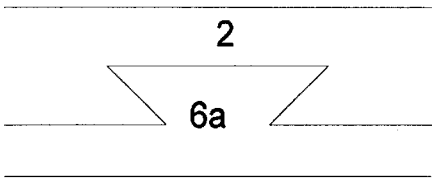
Fig. 1d1
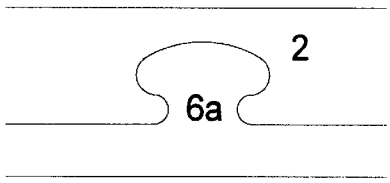
Fig. 1d2

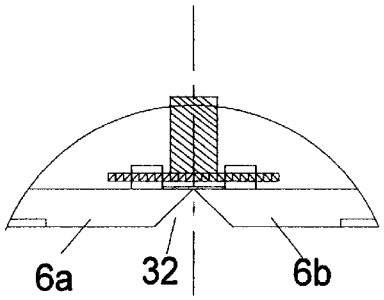
Fig. 6a
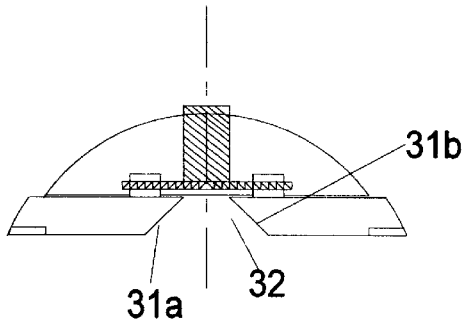
Fig. 6a
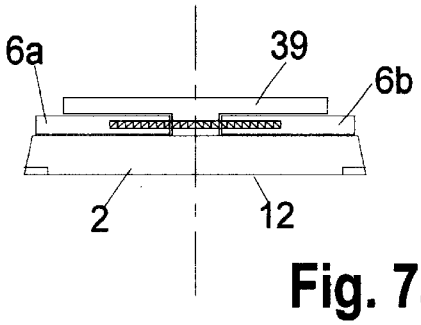
Fig. 7a
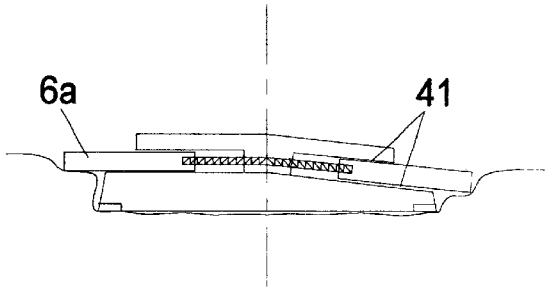
Fig. 7b
Fig. 8a
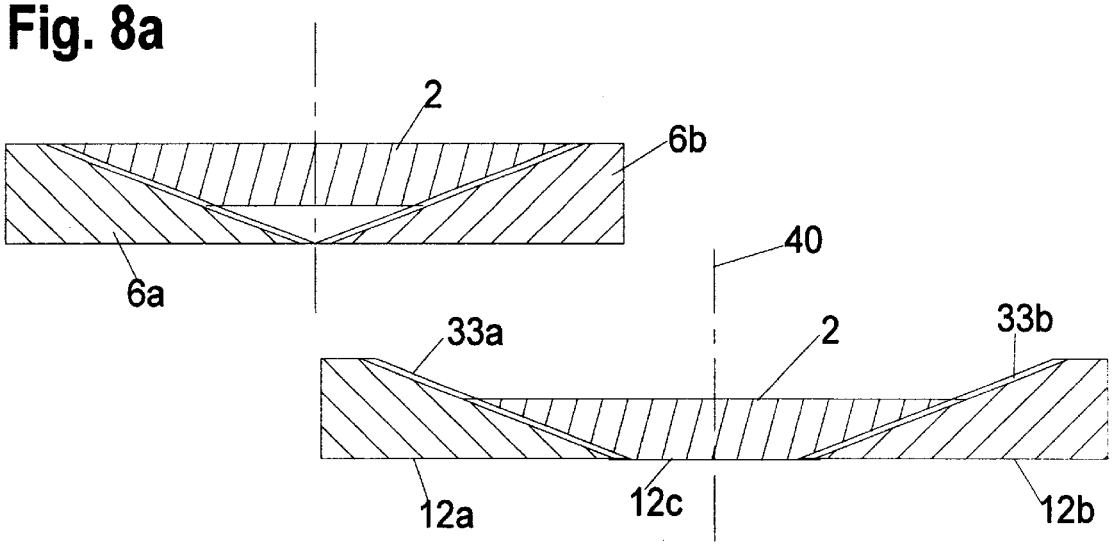
Fig. 8b

WINTER SPORTS DEVICE

BACKGROUND AND SUMMARY OF THE INVENTION

This application claims the priority of German application 100 19 655.1, filed Apr. 20, 2000, the disclosure of which is expressly incorporated by reference herein.

The invention relates generally to a winter sports device.

In this specification the term winter sports device is used to denote an item of sporting equipment with which the user thereof slides on a ground surface by means of one or more sliding runners. The term ground surface is used to include the surface for example of snow, ice and so forth on which the user of the equipment moves. The term sliding runner is used to denote a piece of equipment on which the user stands to move by what is essentially a sliding movement over the ground surface.

The traditionally best-known form of winter sports device is skis which are used in pairs, with a respective ski being individually secured to a respective one of the feet of the user. An alternative configuration of a winter sports device is a snowboard in which the user stands with both feet on one and the same board which is shorter and wider in relation to skis. There are however other less widely known forms of winter sports devices in which the individual sliding runners are connected together by way of suitable mechanisms and so forth.

In all cases involving winter sports devices, there are generally a number of different alternative forms of the respective device, which differ in terms of their configuration according to the respective purpose of use involved. In regard to the configuration of the device, an aspect which is often of crucial influence on the travel and control qualities is the width of the individual sliding runner and what is referred to as the waisting thereof, that is to say the relationship of the widths thereof at the widest point and the narrowest point relative to each other. The narrowest point is generally in a central region of the sliding runner, in relation to the longitudinal direction thereof, that is to say in the case for example of skis the narrowest point occurs in the region of the binding for fixing the foot of the user to the ski, while the wider locations of a ski are at the tip and the tail thereof.

The relationship between the narrowest and the widest parts for example of a ski may vary. Thus for example the design of ski known as a carving ski involves a greater degree of waisting and also a generally shorter length of ski in comparison with a more conventional ski with less sidecut, while in addition it also entails different damping properties, in comparison with a conventional style of ski in which the edges of the ski are generally more parallel by virtue of a lesser degree of waisting and therefore a smaller sidecut.

Likewise, a ski of somewhat greater width is preferred for skiing in deep snow or on powder, in comparison with skiing on a prepared piste or run.

An object of the present invention is to provide a winter sports device such as a ski which can be quickly and reversibly adapted to a respective purpose of use by the user even after purchase thereof.

Another object of the present invention is to provide a winter sports device which includes versatile options of adjustment to differing conditions and differing user requirements.

Yet another object of the present invention is to provide a winter sports device which includes configurational adjustability for adapting the device to the style of use of a respective user in a simple and readily adjustable structure.

In accordance with the principles of the present invention the foregoing and other objects are attained by a winter sports device comprising at least one elongate sliding runner, such as a ski, wherein the width of the sliding runner is at least in part variable.

In accordance with the principles of the present invention the foregoing and other objects are also attained by a winter sports device comprising at least one sliding runner, such as a ski, wherein the waisting of the sliding runner is at least in part variable.

For the purposes of the description hereinafter reference will be made more specifically to skis as a particular form of the winter sports device with which the invention is concerned, in which respect it will be clear that the aspects, features and description set out hereinafter can be equally applied to any kind of winter sports devices involving sliding runners.

As will be noted from the description hereinafter of preferred embodiments, a variation in the width or the waisting of the skis, or both parameters, means that the basic shape of the ski can be adapted to any desired position of use. The nature of the variation in width and/or waisting can ensure that such variation can be effected very quickly and easily, that is to say even while the ski is in use, even if not necessarily while the user is moving on the ski, so that adaptation of the ski can be implemented quickly and as soon as the conditions of use at a respective location are known to the user.

Because of the high levels of mechanical loading which act on the sliding runner or ski, more particularly in the region of the outer edges which are generally at the outer edge portion of the underneath sole or ground-engaging surface of the ski, the edges of the ski generally comprise metal. For that reason, all structures which involve pivotal movement or displacement of individual parts of the ski relative to each other in relation to a basic position involve the mechanical connecting elements between the parts being of a highly stable and sturdy configuration.

A preferred option in that respect provides that the ski, as viewed in cross-section, comprises a plurality of individual parts, for example a central part and side parts, wherein the individual parts are adapted to be movable relative to each other to vary the width and/or waisting involved. For example the running surface or sole of the ski may comprise first and second parts which are movable relative to each other in a transverse direction and which are mounted displaceably to the underside of a central part which itself does not come into contact by means of a running surface or sole surface with the ground surface. In order to prevent snow from penetrating into the resulting gap when the side parts are moved away from each other in order thereby to increase the width of the ski, a further feature of the invention provides that a seal of a flexible material, for example a sheet or foil or a fabric material, can be disposed at that location. Movement of the two side parts towards and away from each other can be implemented by means of an adjusting screw having a screwthread which at the same time is of a self-locking action so that the adjustment once set is retained.

Another possible configuration provides that the central part and the side parts of the ski are adapted to be pivotable or tiltable relative to each other about axes which extend in the longitudinal direction of the ski.

In such an arrangement it is possible for the side parts which represent the increase in width of the ski to be taken fully out of operation, that is to say removed, or pivoted upwardly into a position on the top side of the central part of the ski, when the ski is to be in its narrowest configuration. It will be appreciated that in such a case the central part must be provided along its outside edge portions themselves with wear-resistant edges which are provided at that location to enable the ski to produce its edging effect for turning, when the ski is adjusted into its narrowest version. The increase in width of the ski can be achieved by pivoting the side portions down and fixing them in the downwardly pivoted position. That configuration does not allow a continuous, stepless increase in width of the ski.

In contrast, such a stepless variation in the width of the ski can be achieved if the individual parts which are movable relative to each other, that is to say for example the above-mentioned central part and side parts, are admittedly adapted to be pivotable relative to each other about axes directed in the longitudinal direction of the ski, but all individual parts of the ski, in use thereof, are in opposite relationship to the ground surface for engagement therewith, when the ski is in both the wide and also the narrow condition thereof. The variation in width of the ski is effected by altering the angular position of the individual parts thereof relative to each other, so that for example in the narrow condition the individual parts, as viewed in cross-section, form a zigzag-shaped or wave-shaped configuration, whereas in the wide condition of the ski in the transverse direction they are oriented in such a way as to afford in the transverse direction a straight and in particular flat underside and thus sole surface.

In a preferred feature of the invention, the individual parts of the ski are fixed in the desired relative position with respect to each other by virtue of fixing intermediate wedge members which extend in the longitudinal direction, between the individual parts, and spreading them apart in regard to their relative position with respect to each other in the desired manner. Depending on the respective number and configuration of the individual parts involved in the ski, such intermediate wedge members may also have arm portions which project in the transverse direction, for the purposes of fixing individual parts of the ski, which are disposed at more remote locations.

The central part itself may also in turn be of a multi-part nature, in particular comprising first and second parts.

A further preferred feature of the invention can provide that the increase in or reduction in width of the ski can be effected in spite of the ski being of a one-piece configuration in cross-section. One possible option in this respect involves the ski being of a wave-shaped or zigzag-shaped cross-sectional contour, wherein the ski is flattened out for the purposes of increasing its width while the wave shapes or raised portions and depressed portions are respectively higher and deeper when the ski is to be in a narrower condition. In that respect in particular the narrower condition is the initial condition and the ski can be moved into the flatter, wider condition by virtue of suitable spreading means, for example of mechanical, pneumatic or hydraulic nature. It will be noted in this respect that in the above-outlined constructions involving increasing or reducing the width of the ski by extending or retracting side parts, extension and/or retraction can also be effected by mechanical, pneumatic or hydraulic means.

In a preferred feature of the invention a sliding runner or ski may have a central part which is arranged from the point of view of height in the interior of the side parts at respective sides thereof so that, when the side parts are moved away from each other to increase the width of the ski, the inwardly disposed central part serves as a guide means. It is precisely in such cases that the central part can be used as a piston and the variation in width can be implemented by a procedure whereby a fluid such as air or a liquid such as oil can be introduced into or discharged from an empty space or chamber between the central part and the side parts in order thereby to vary the width of the ski and also fix it.

Depending on whether the variation in width is implemented uniformly over the entire length of the sliding runner or ski or in part in the front and rear regions thereof, it is thereby possible to vary not only the width but also the waisting of the ski when considered in plan. Preferably, in all structures involving mechanical adjustment, the ski has an axis of rotation for the individual parts which are displaceable or pivotable to provide for the variation in width of the ski, with respect to the central part, with the axis of rotation being disposed in the central region of the ski, in particular in the front and rear regions of the binding thereon. If in addition those axes of rotation are movable in a transverse direction relative to the ski, it is possible to choose between the waisting of the ski remaining the same and the waisting of the ski being varied, in addition to the variation in width of the ski.

Further objects, features and advantages of the invention will be apparent from the description hereinafter of preferred embodiments.

Other objects, advantages and novel features of the present invention will become apparent from the following detailed description of the invention when considered in conjunction with the accompanying drawings.

BRIEF DESCRIPTION OF THE DRAWINGS

FIG. 1*a* is a plan view of a winter sports device according to the invention comprising a pair of skis;

FIGS. 1*b* and 1*c* show view in cross-section of a ski as shown in FIG. 1 in a narrow condition and in a wide condition;

FIGS. 1*d*1 and 1*d*2 are detail views of mechanical guides between individual parts of the skis shown in FIG. 1*a;*

FIGS. 6*a* and 6*b* show views in cross-section of a ski in a narrow condition and in a wide condition, with another mechanical structure;

FIGS. 7*a* and 7*b* show views in cross-section of a ski in a narrow condition and in a wide condition in yet another structure;

FIGS. 8*a* and 8*b* show views in cross-section of a ski in a narrow condition and in a wide condition in yet another structure;

DETAILED DESCRIPTION OF THE PREFERRED EMBODIMENT

Figure 2A:
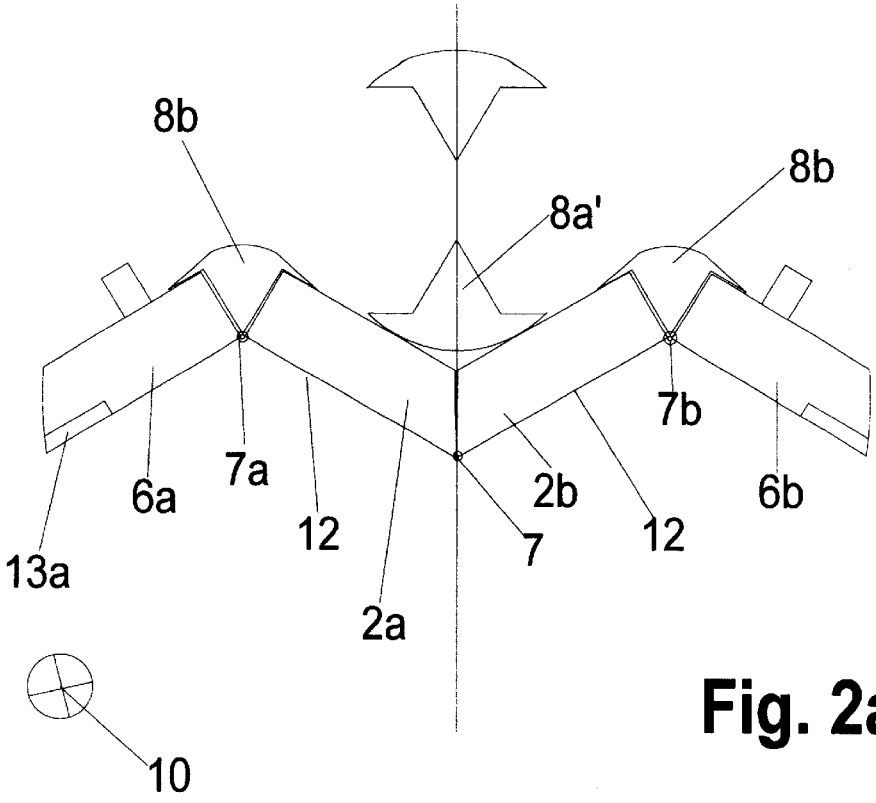
FIG. 2*a* is a view in cross-section of a further embodiment of a ski according to the invention, comprising a plurality of parts, shown in a narrow condition.

Referring firstly to FIG. 1*a,* shown therein is a plan view of a winter sports device in the form of a pair of skis, therefore comprising first and second elongate sliding runners indicated at 1*a* and 1*b,* more specifically the skis themselves, on each of which is fixed a respective ski binding 17*a,* 17*b* on the top surface of the respective ski in a central region as indicated at 15 thereof.

In this respect, the right-hand elongate sliding runner or ski indicated at 1*b* in FIG. 1*a* shows in broken lines the variability options which are entailed with this sliding runner 1*b:* thus the left-hand edge thereof can be completely extended outwardly towards the left, which corresponds to a uniform increase in width thereof, without a variation in the waisting of the ski.

In contrast, an increase in width of the ski is shown at the right-hand side of the right-hand elongate sliding runner 1*b,* only in the front and rear regions thereof, that increase in width being implemented by an outward pivotal movement of the edge 14 of the ski about respective pivot axes indicated at 16*a* and 16*b* which are disposed in the region of the front and rear ends respectively of the ski binding 17*b,* in the proximity of the outward edge of the central part 15 of the ski.

An outward pivotal movement of that kind provides that the ski 1*b* is increased in width in the front and tail regions thereof, but in contrast in the central region thereof, in regard to the longitudinal direction thereof, it remains of the same width or under some circumstances may even become narrower. This varies what is referred to as the waisting of the ski, the term waisting as indicated above denoting the relationship of the widest to the narrowest points of the ski and also the configuration of the variation therein.

Thus the outwardly pivoted or outwardly moved front and tail regions, in particular of the side parts 6*b,* 6*b*', can be connected together in a central connecting region 18 which more particularly can be disposed beneath the ski binding 17*b,* a fact which can enhance the stability of the structure overall.

Outward displacement of the rotary axes 16*a,* 16*b* and possibly also the connecting region 18 can provide for a variation in the waisting of the ski, independently of or in addition to the variation in width. In that way it is even possible to vary the waisting on the outside and the inside of the ski, in mutually independent relationship.

Reference will be made hereinafter to the sectional views in FIGS. 2 through 5 which, except for FIGS. 1*d*1 and 1*d*2, represent a view in section through a sliding runner taken along line II—II in FIG. 1*a,* to more clearly show specific variation options in terms of the modification in width of the sliding runner.

At this point however attention will be directed to FIGS. 1*b* and 1*c* showing a sliding runner according to the invention in a narrow condition and a wide condition respectively. References 6*a* and 6*b* denote side portions or parts which are arranged on a central portion 2 disposed centrally in a transverse direction 11, with the side portions 6*a* and 6*b* being arranged at the underside of the central portion 2. The underside surfaces of the side portions 6*a,* 6*b* in turn form the underneath or sole surface of the ski, as indicated generally at 12 in FIGS. 1*b* and 1*c*. In a corresponding fashion, the side portions 6*a* and 6*b* also have along their outside edge the sliding edge portion indicated at 13*a,* 13*b* which is usually fitted into the respective side portion as a separate individual component.

The central portion 2 therefore does not come into contact with the ground surface at all, not even with its underside.

The lateral outward movement of the side portions 6*a,* 6*b* into the widened condition as shown in FIG. 1*c* results in the formation therebetween at the center of the ski of a gap 4 which is closed by a suitable sealing means, preferably a sheet or foil or textile web or the like, as indicated at 5, in regard to which it must be ensured that in the narrow condition of the ski as shown in FIG. 1*b* it folds upwardly and therefore inwardly of the ski, which can be ensured by virtue of the way in which the seal 5 is secured to the side portions 6*a* and 6*b*.

FIG. 1*c* also shows a possible way of setting and fixing the side portions 6*a* and 6*b* which can be displaced steplessly outwardly and inwardly again. Displaceability in the outward direction can be implemented for example by way of a setting or adjusting screw 3 which in respective end regions thereof has screwthreads of opposite pitches which run in corresponding spindle nuts 19*a,* 19*b* which are fixedly secured to the side portions 6*a,* 6*b*. When the screw 3 is rotated, the spindle nuts 19*a* and 19*b* are urged outwardly or drawn inwardly, together with the side portions 6*a* and 6*b* to which they are mounted. When the threads at the respective end regions of the screw 3 are of the same pitch but in opposite hand, then the movements of the side portions 6*a* and 6*b* will take place in different directions and to the same degree relative to the center of the ski.

In this arrangement, the adjusting screw 3 is mounted in the central portion 2 and can be moved in particularly by means of, for example, a knurled wheel which can be supported in the central portion 2 rotatably about a horizontally transversely extending axis. The wheel can mesh, for example, by way of a tooth configuration or knurled or spline configuration provided on the outside periphery thereof with a contouring which is similarly afforded in the central region of the screw 3 which in fat also extends horizontally and transversely.

Reference will now be made to FIGS. 1*d*1 and 1*d*2 showing mechanical guide systems for the sliding guidance of two individual parts with respect to each other, in this case by way of example the central portion 2 with respect to a side portion 6*a,* such as for example the dovetail-shaped guide configuration shown in FIG. 1*d*1 or a contour as shown in FIG. 1*d*2 which is similar to the configuration shown in FIG. 1*d*1 but rounded off, while still being of a generally undercut shape. Guide configurations of that kind can be used in particular when the ski involves the option of an increase in width thereof over its entire length, that is to say linear displaceability of a side portion 6*a* with respect to the central portion 2 in the transverse direction of the ski, as illustrated in FIG. 1*a* at the left-hand edge of the right-hand ski therein.

In comparison, the views in FIG. 2 show a structure in which the central portion 2 has a running or sole surface 12 at the underneath thereof, with which the elongate sliding runner or ski can slide on a ground surface. In addition, in this case the central portion 2 is of a multi-part nature, consisting of individual parts 2*a* and 2*b*. A left-hand side portion 6*a*, a left-hand central part 2*a*, a right-hand central part 2*b* and a right-hand side portion 6*b* are pivotably connected together continuously in that sequence from left to right by way of respective pivot axes as indicated at 7*a* and 7*b* which extend in the longitudinal direction of the ski, as indicated at 10 in for example FIG. 2*a*.

Figure 2B:
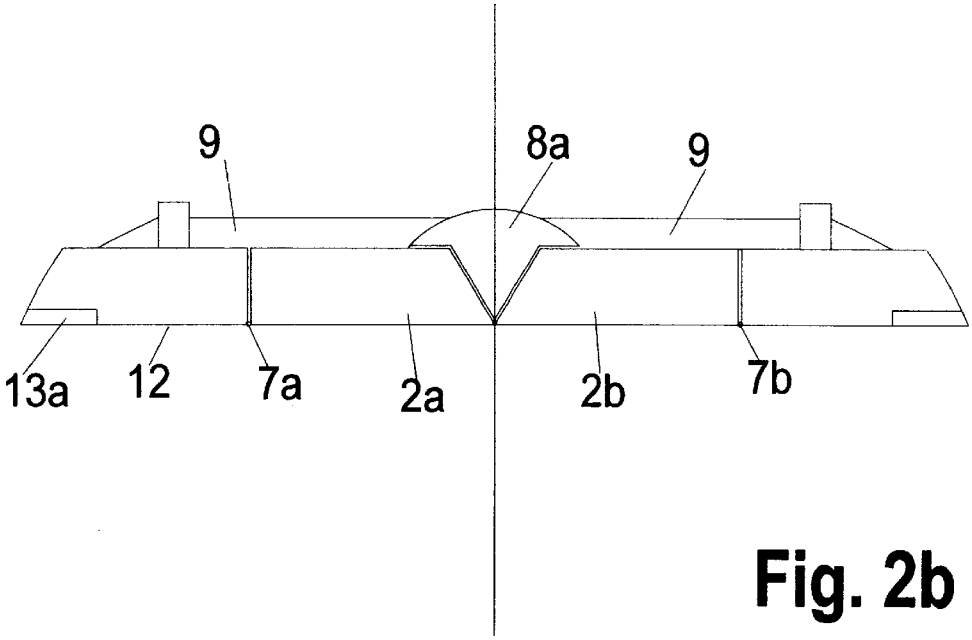
FIG. 2*b* shows the ski of FIG. 2*a* in the wide condition thereof.

In the wide condition of the ski as illustrated in FIG. 2*b*, the sole surfaces 12 of the individual parts form in that case a surface which is continuous in the transverse direction and which in particular is flat.

In the narrow condition of the ski as illustrated in FIG. 2*a*, the sole or underneath surfaces of the individual parts are in contrast disposed at an angle relative to each other, preferably an obtuse angle.

By virtue of the nature of the inclined positioning of the narrow sides of the individual parts, which are directed towards each other, it is possible to provide in particular for fixing of the individual parts relative to each other in the narrow condition or in the wide condition respectively, by virtue of the insertion of suitably shaped intermediate wedge members as indicated at 8*a*, 8*a*' and 8*b* in FIGS. 2*a* and 2*b* respectively. Using different intermediate wedge members, that is to say for example those involving varying wedge angles, it is possible to achieve intermediate positions between the narrow condition and the wide condition illustrated.

Thus, the narrow sides of the central parts 2*a*, 2*b* which are directed in mutually facing relationship and which extend in the longitudinal direction 10 of the ski are so inclined or bevelled relative to the underneath or sole surface 12 thereof that, when the underneath or sole surfaces 12 are in a mutually aligned and thus flat condition, the mutually facing narrow side surfaces of the central parts 2*a* and 2*b* form a generally V-shaped, upwardly open gap between the two central parts 2*a* and 2*b*, as can be clearly seen from FIG. 2*b*. The components can then be fixed in that position by the insertion of a central intermediate wedge member 8*b*, whereby the central parts 2*a*, 2*b* are already held in the extended wide position relative to each other, but they are not yet fixed definitively in that position. Fixing can be effected by virtue of an undercut positively locking engagement being produced in the direction of insertion of the intermediate wedge member 8*a*. In a simpler configuration however, by way of example, fixing can also be effected by the arrangement on the central intermediate wedge member 8*a* of lateral arms or cantilever projections 9 which extend outwardly until they can co-operate with the outwardly disposed side portions 6*a* and 6*b* and there for example can engage under suitable retaining means such as holding loops, support brackets or the like. That is possible by virtue of inserting the central intermediate wedge member 8*a* from above, in a position such that the arms or projections 9 are directed transversely, followed then by slight rotational movement of the central intermediate wedge member about a vertical axis or displacement in the longitudinal direction 10 until the arms or projections 9 come into engagement with the support brackets, holding loops or other suitable holding elements which, as indicated above, are disposed in particular on the top side of the side portions 6*a* and 6*b*.

In this wide extended condition, the narrow sides or end faces which are disposed perpendicularly to the sole surface 12 and which are on the outward sides of the respective central parts 2*a* and 2*b* bear against the inwardly facing sides or end faces of the side portions 6*a* and 6*b* and therefore are supported against each other in particular in the upper region thereof in such a way that additional fixing on the top side of the ski gives rise to a stable extended contour in the transverse direction.

In contrast, in the narrow condition of the ski as shown in FIG. 2*a* which involves a zigzag-shaped configuration, the central parts 2*a* and 2*b* bear against each other with their mutually facing central narrow sides or end faces 21*a*, 21*b* whereby the sole surfaces 12 of the central parts 2*a*, 2*b* adopt a position affording a slight V-shaped contour with an angle of more than 180° on the underneath free side.

By virtue of the insertion of lateral intermediate wedge members 8*b* from above between a side portion 6*a* and the adjoining central part 2*a*, and between a side portion 6*b* and an adjoining central part 2*b*, the side portions 6*a* and 6*b* and the adjoining central parts 2*a* and 2*b* respectively also form a V-shaped contour, but with an angle of somewhat less than 180° on the free underneath side.

Fitting a central intermediate wedge member 8*a*' between the central parts 2*a* and 2*b* as shown in FIG. 2*a* provides that those parts are fixed relative to each other. For that purpose, it is necessary to provide a fixing, for example involving positively locking engagement, between the intermediate wedge member 8*a'* and the central parts 2*a*, 2*b* which are to be connected together, as must also be the case in regard to the lateral intermediate wedge members 8*b* in relation to the operatively associated parts 6*a*, 2*a*, 6*b* and 2*b*.

The central intermediate wedge member 8*a'* which is used in this narrow condition of the ski as shown in FIG. 2*a* may involve a side wedge member corresponding to a wedge member 8*b*, which has been turned through 180° about a horizontal axis, that is to say inverted, and which is used to bear with its external contour or head surface against the adjoining central parts 2*a*, 2*b*, as can be clearly seen from FIG. 2*a*. FIG. 2*a* shows a wedge member corresponding to a wedge member 8*b* after it has been moved to a position above the join between the two central parts 2*a* and 2*b*, while still in the position corresponding to the position adopted by the intermediate wedge member 8*b*, and then, below the transposed wedge member, the wedge member 8*a'* after it has been inverted into its operative position.

Using intermediate wedge members 8*a*, 8*b*, 8*a'* involving different wedge angles makes it possible to vary the change in width of the ski.

Figure 3A:
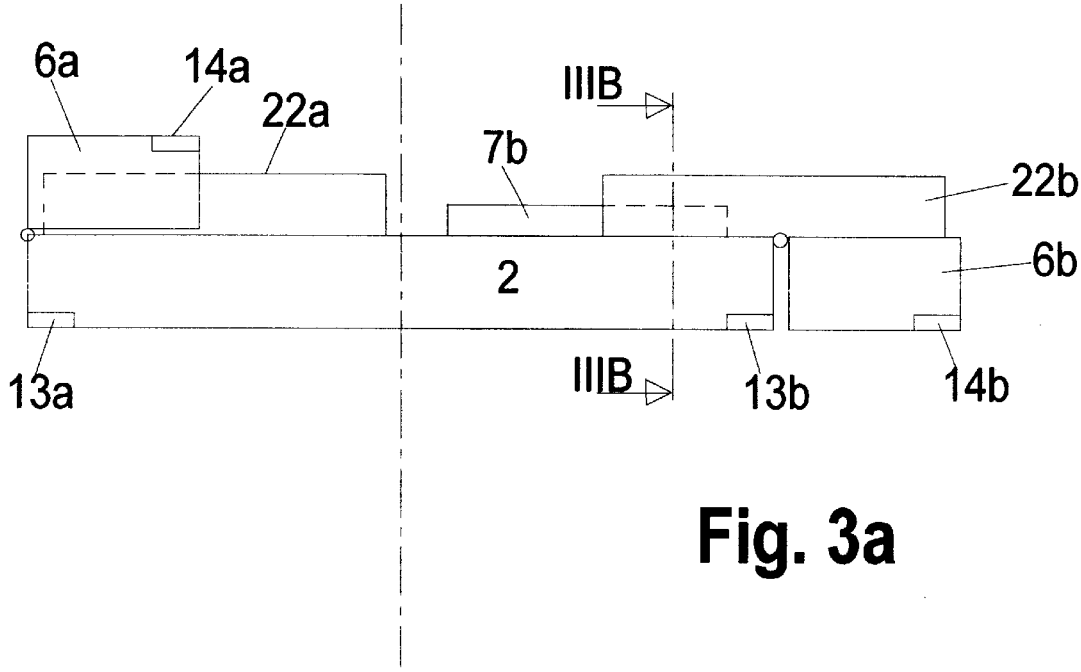
FIG. 3*a* is a view in cross-section of a further embodiment comprising a plurality of parts, in the wide condition.
Figure 3B:
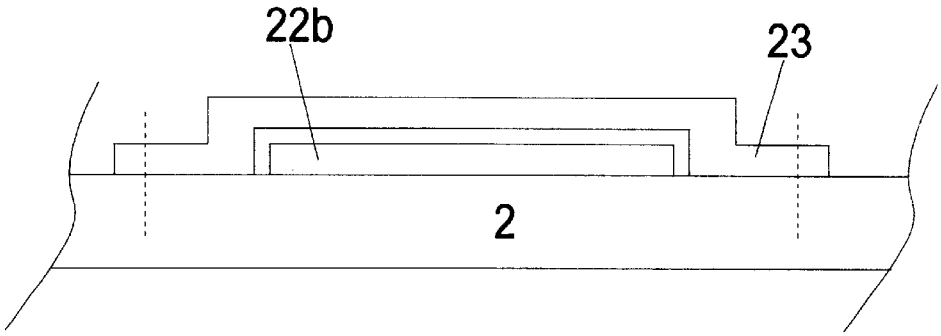
FIG. 3*b* is a view in cross-section taken along line IIIB—IIIB in FIG. 3*a* of a slightly modified structure thereof.

That consideration is not an option in regard to the structure shown in FIG. 3 to which reference will now be directed. Looking therefore at FIGS. 3*a* and 3*b*, the elongate runner shown therein in the form of a ski comprises a central portion 2 which has its own underneath or sole surface corresponding to the sole surface 12 referred to hereinbefore and edge portions 13*a* and 13*b* which are laterally fitted therein and which engage the ground surface for edging control of the ski. The left-hand half of FIG. 3*a* shows the edge portion 13*a* in a position such that it can engage the ground for ski edging control. In the right-hand half of FIG. 3*a*, the ski is shown in a wide condition in which a side portion 6*b* has been pivoted down so that it is in alignment with the central portion 2, and fixed in that position, for example by a slider 22*b* which is mounted slidably in the transverse direction 11 of the ski on the top side of the central portion 2 thereof. For the purposes of fixing the ski in the wide condition, the slider 22*b* can be displaced outwardly to overlap the top side of the side portion 6*b*. Reference numeral 14*b* shows an edge portion which is used for edging control of the ski when the ski is in the wide condition.

Referring now to FIG. 3*b,* and viewing in the direction indicated by the arrow IIIb in FIG. 3*a,* shown therein is such a slider 22*b* in a slightly modified version, insofar as in this case the slider 22*b* is arranged in the interior of a generally hat-shaped guide 23 in order to reduce the likelihood of soiling and contamination thereof.

Figure 4A:
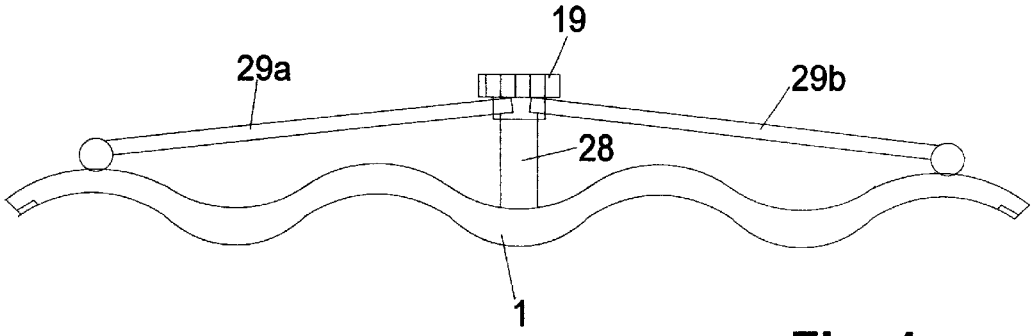
FIG. 4*a* shows a structure according to the invention with a sliding runner which is in one piece in cross-section, in the narrow condition.
Figure 4B:
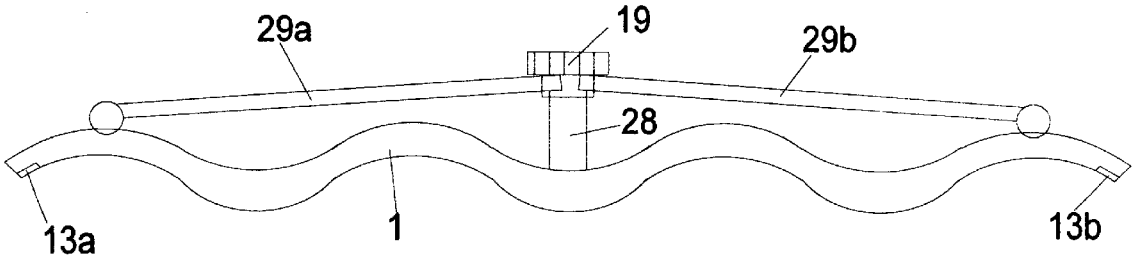
FIG. 4*b* is a view corresponding to FIG. 4*a* showing the sliding runner in a wider condition.

Referring now to FIGS. 4*a* and 4*b,* shown therein is a sliding runner 1 which is in one piece in cross-section and which entails a wavy or corrugated contour, as can be clearly seen from the views. In this respect, the narrow condition illustrated in FIG. 4*a* exhibits a greater degree of corrugation, in other words, the corrugations are closer together and the depths and heights of the respective parts of the corrugations are greater than in the wide condition of the ski as shown in FIG. 4*b* where the corrugation configuration is less pronounced and is thus of lower amplitude. In this respect, one of the two conditions illustrated is the initial condition or starting condition of the elongate runner which therefore has to be moved into the respective other condition by mechanical means, that is to say, by means which push the sliding runner together into the condition shown in FIG. 4*a* starting from the condition shown in FIG. 4*b* or which urge it apart from the narrow condition shown in FIG. 4*a* into the wide condition shown in FIG. 4*b*. That is possible for example by means of a screwthreaded bolt or stud 28 which is disposed vertically approximately at the center of the width of the sliding runner and along which a spindle nut 19 can be screwed up and down. Arranged beneath the spindle nut 19 on a support washer or the like support member are cantilever arms 29*a,* 29*b* having free ends which are pivotably secured to the sliding runner 1 in the proximity of the laterally outward edges thereof. By virtue of the spindle nut 19 being screwed down the bolt or stud 28, the cantilever arms 29*a* and 29*b* are pressed down to an ever increasingly flat condition from the position shown in FIG. 4*a* so that the corrugation configuration of the sliding runner 1 in the transverse direction also becomes progressively flatter and straighter so that the width of the sliding runner 1 becomes gradually greater.

For that purpose the sliding runner 1 must comprise an at least limitedly elastic material and in particular in that respect the sliding runner is not of a uniform thickness in the transverse direction. Preferably, the trough portions of the corrugation configuration which must carry at the underside thereof the greatest pressure from the ground surface on which the sliding runner is disposed are of a greater thickness than the raised or peak portions of the corrugation configuration, in which elastic deformation thereof can then preferably take place.

Figure 5:
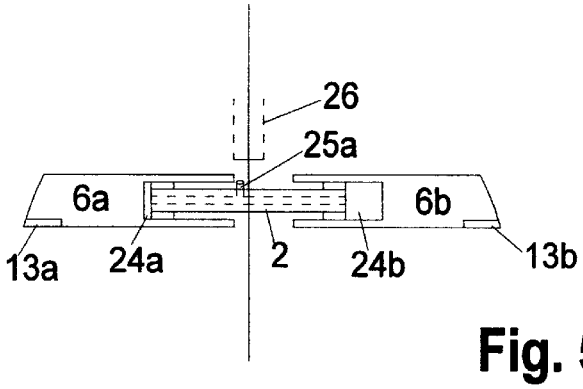
FIG. 5 shows a further configuration of a multi-part structure.

Attention is now directed to FIG. 5 showing a further multi-part structure which in some ways can be viewed as being similar to the structures shown in FIGS. 1 through 3 insofar as once again the elongate sliding runner has side portions 6*a* and 6*b* which are displaceable in the transverse direction thereof with respect to a central portion 2. It is in consideration of the similarity between the structures shown in FIGS. 1 through 3 and the structure shown in FIG. 5, that the same reference numerals will also be used in the description relating to FIG. 5, to denote the same components.

In contrast to the structure shown in FIGS. 1*b* and 1*c* however the central portion 2 is not disposed on the top side of the side portions 6*a* and 6*b,* but in the region of the body thereof, more specifically being guided in the interior of the side portions 6*a* and 6*b* in a suitable recess 24*a* and 24*b* which is provided there and which is open towards the center of the sliding runner or ski.

This guide arrangement can be in the form of a mechanical guide or, as shown in FIG. 5, it can additionally be in the form of a piston-cylinder structure.

In that case, the central portion 2, either in punctiform fashion or over a relatively long extent of the sliding runner in the longitudinal direction thereof as indicated at 10 in FIG. 2*a,* can act as a piston which is in sealed relationship with respect to the side walls of the recess or opening 24 which acts therefore as a cylinder. The free space which is afforded between the central portion 2 acting as the piston and the recess 24 acting as the cylinder, that is to say in front of the outer end face of the piston, is a working volume into which a fluid, being therefore a gas or a liquid, can be introduced or from it can be discharged, in order to adjust and also fix the width of the ski.

In that respect an appropriate arrangement is for the fluid to be supplied or discharged by way of lines or ducts 25*a,* 25*b* which are arranged in the central portion 2. To make use of that arrangement, a storage container 26, for example in the form of a pump or a bellows member capable of applying pressure or a suction effect, can be applied to the top surface of the center of the central portion 2, that is to say between the side portions 6*a* and 6*b,* and fluid can be supplied to the piston-cylinder arrangements uniformly at both sides of the assembly by way of a central line or duct 25*a* with which the container 26 thus communicates, and distributor lines or ducts 25*b* which branch away substantially horizontally laterally from the central line or duct 25*a*.

Reference numeral 27 denotes a valve which can be provided at the point of connection between the container 26 and the central line or duct 25*a,* with the valve 27 for example being closed in the normal condition and being openable only by virtue of the application of the container 26 thereto. This means that, after the container 26 is removed, the sliding runner or ski is fixed in the condition to which it has been set.

It will be appreciated that it is precisely when using a liquid as the operating fluid in such an arrangement that the width of the sliding runner or ski is more or less definitively fixed in that way as the very low level of compressibility of liquids means that the width of the sliding runner or ski can only be varied to an amount which is in practice scarcely perceptible.

Reference will now be made generally to FIGS. 6 through 12 showing further mechanical options for easily varying the width of the sliding surface of the ski.

Reference will firstly be made to FIG. 6*a* which in that respect shows a structure similar to that shown in FIGS. 1*b* and 1*c*. In this case also when the ski is in the narrow condition, movement of the ski over the ground surface takes place on the sole or running surfaces 12 of the two side portions 6*a* and 6*b,* the lower outside edges of which also carry the edge portions 13*a,* 13*b* which usually consist of metal for edging control of the ski.

In the narrow condition of the ski as shown in FIG. 6*a,* the side portions 6*a* and 6*b* are moved towards each other, towards the longitudinal center line of the ski, and in particular they are moved towards each other until they actually come into contact with each other, as can be clearly seen from FIG. 6*a*. The mutually facing end faces of the side portions 6*a* and 6*b* in this case however have a bevel configuration as indicated at 31*a,* 31*b* so that, when they are in their mutually approached condition, they form a generally V-shaped central groove or channel 32.

When the side portions 6*a* and 6*b* are moved further away from each other, as shown in FIG. 6*b* illustrating the ski in the wide condition, that central groove or channel 32 is thus wider and is of a generally trapezoidal shape.

The advantage of this structure over that shown in FIGS. 1*b* and 1*c* is that the gap indicated at 4 in FIG. 1*c,* which occurs at the longitudinal center of the ski in the wide condition, does not have to be covered over by a seal 5 as in FIG. 1*c,* but can remain open towards the ground surface. Any snow which is deposited in the central groove or channel 32 when the ski is in the wide condition as shown in FIG. 6*b* is easily urged out of the central groove or channel 32 in a downward direction by virtue of the inclined surfaces 31*a,* 31*b* when the side portions 6*a,* 6*b* are pushed towards each other, with the snow being displaced downwardly as by a knife blade which is ground at one side. The two side portions 6*a* and 6*b* can be displaced relative to each other in the same manner as with the structure shown in FIGS. 1*b* and 1*c,* by means of spindle nuts as indicated at 19*a* and 19*b* in FIG. 1*b,* with respect to a fixed central portion 2 which is arranged above the side portions 6*a* and 6*b,* or by any other suitable manner of displacement of the side portions.

At this point, in relation generally to FIGS. 8, 9 and 11, it will be noted that the structures shown therein differ in principle from that shown in FIGS. 6*a* and 6*b* in that the wide condition of the ski, in comparison with the narrow condition thereof, is attained by virtue of a central portion as indicated at 2 being lowered between the pushed-apart side portions 6*a* and 6*b*. The central portion 2 also has a running or sole surface 12 and can then slide on the ground surface on which the ski is used.

In the case of the structure shown in FIGS. 8*a* and 8*b,* for that purpose the side portions 6*a* and 6*b,* at least over a part of their longitudinal extent, have an inclined guide configuration 33*a* and 33*b* which extends conically inclinedly from the inside upwardly and outwardly. In the narrow condition of the ski the side portions 6*a* and 6*b* are moved towards each other as far as possible, relative to the longitudinal center as indicated at 40 in 8*b,* so that the overall sole surface of the ski in that condition only comprises the sole surfaces 12*a* and 12*b* of the side portions 6*a* and 6*b* which leave between them as far as possible no gap.

The central portion 2 is disposed in a generally V-shaped groove 34 which is formed by the inclined guide configurations 33*a* and 33*b* and which increases in width in an upward direction. At its outwardly and downwardly directed regions, in inverse similarity to the inclined guide configurations 33*a* and 33*b,* the. central portion 2 has a counterpart inclined guide configuration indicated at 33*c* which runs in positively locking relationship in the inclined guide configurations 33*a* and 33*b*.

The ski can be increased in width by the central portion 2 being pressed downwardly relative to the side portions 6 and 6*b,* whereby the central portion 2 slides downwardly with its counterpart inclined guide configuration 33*c* along the inclined guide configurations 33*a* and 33*b* of the side portions 6*a* and 6*b* until the sole surface 12*c* of the central portion 2 is in one plane with the sole surfaces 12*a* and 12*b* of the side portions 6*a* and 6*b*. After the central portion 2 is arrested in that lowered position by suitable locking means (not shown), the ski is then in its wide condition.

Figure 9A:
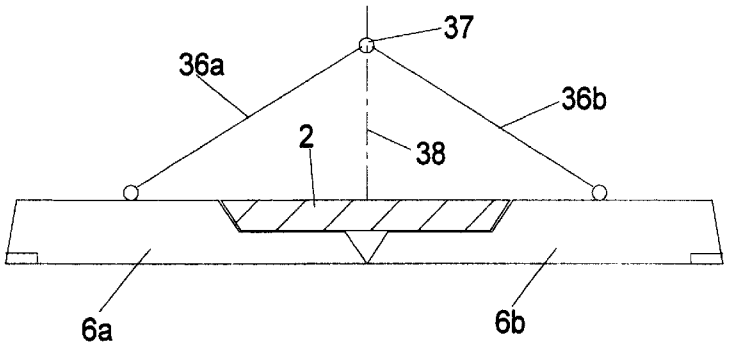
FIGS. 9*a* and 9*b* show views in cross-section of a ski similarly to FIGS. 8*a* and 8*b* in a structure which is derived therefrom.
Figure 9B:
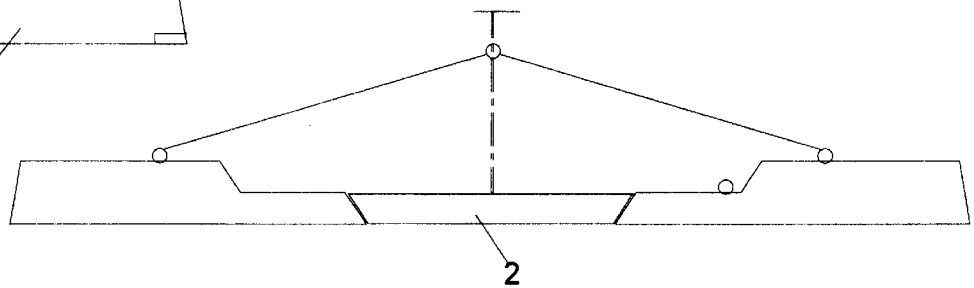

The structure shown in FIGS. 9*a* and 9*b* is generally similar and also functions in a similar fashion, but in this case the outwardly upwardly directed contact surfaces of the side portions 6*a* and 6*b* and the inwardly downwardly directed counterpart surfaces of the central portion 2 are stepped in a two-stage configuration in respect of height and provided with separate similar inclined portions. The two heightwise regions are preferably of the same height. By virtue of that arrangement, in the narrow condition of the ski in which the sole surfaces 12*a* and 12*b* of the side portions 6*a* and 6*b* are moved entirely towards each other and into directly adjoining relationship, the central portion 2 can still find space in the upper heightwise half between the side portions. As this arrangement no longer involves a continuous smooth inclined guide configuration from top to bottom, but therebetween the side portions each have a horizontal surface as indicated at 35*a* and 35*b* which has to be overridden by the central portion 2 in its downward movement but along which the central portion 2 cannot be simply pushed downwardly, this arrangement requires the side portions 6*a* and 6*b* to be actively moved away from each other to then permit the central portion 2 to be moved downwardly therebetween.

That is implemented by means of a mechanism including on the one hand two pivot arms 36*a* and 36*b* which are pivotably secured to the top side of the respective side portions 6*a* and 6*b* and which extend from there inclinedly upwardly where they are pivotably connected together at a connecting point 37. From that connecting point 37, pressure can be applied vertically downwardly centrally to the central portion 2, for example by means of an adjusting screw indicated at 38.

By virtue of the fact that the mechanism is designed in such a way that the adjustment mechanism for increasing the width of the ski provides that firstly the side portions 6*a* and 6*b* are pushed away from each other and at the same time or immediately thereafter the central portion 2 is moved downwardly until the sole surfaces 12*a* and 12*b* of the side portions and the sole surface 12*c* of the central portion 2 are at the same level, this means that both necessary movements are executed by one and the same triggering movement.

Figure 11A:
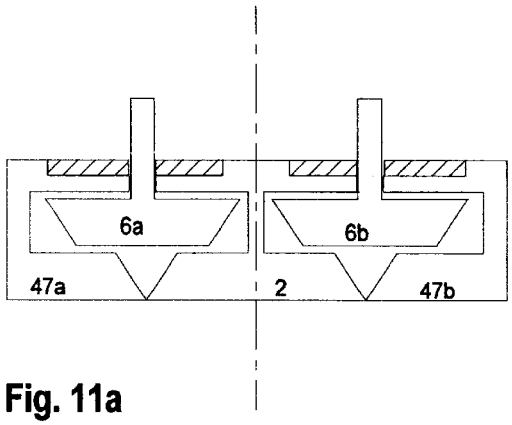
FIGS. 11*a* and 11*b* show views in cross-section of a ski in a narrow condition and in a wide condition in yet another structure.
Figure 11B:
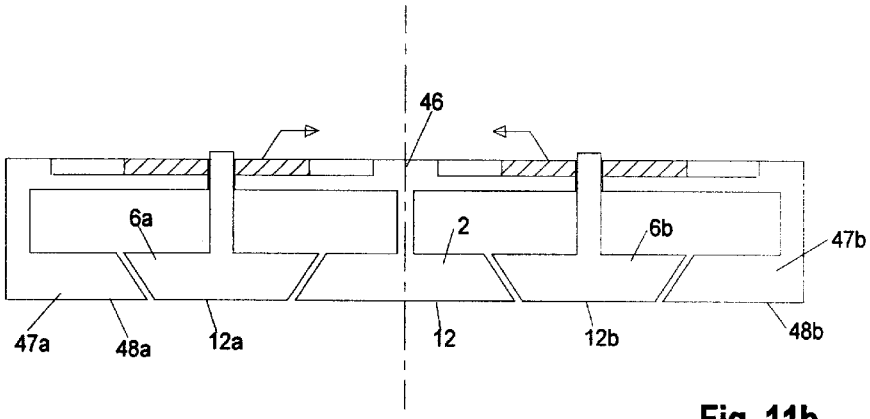

Referring to FIGS. 11*a* and 11*b,* shown therein is a further structure which involves introducing a central portion 2 from above between two side portions for the purposes of increasing the width of a ski. In this case, the ski, when already in the narrow condition, comprises a central portion 2 which has a running or sole surface 12. The central portion 2 is fixed to a center part 46 which is disposed thereabove.

Side portions 6*a* and 6*b* are also vertically movably secured to the center part 46. The side portions can be displaced vertically downwardly with respect to the center part 46 for increasing the width of the sole surface of the ski until the corresponding sole surfaces 12*a* and 12*b* of the side portions 6*a* and 6*b* are at the same level as the sole surface 12 of the central portion 2 and thereby increase the width thereof. For the purposes of better support against each other, the edge contact surfaces of the central portion 2 and the side portions 6*a* and 6*b* may be angled to extend parallel to each other.

It is also possible for edge portions indicated at 47*a* and 47*b* with sole surfaces indicated at 48*a* and 48*b* to be arranged laterally outside the central portion 2, with the edge portions always being at the same heightwise level as the central portion 2.

Those edge portions 47*a* and 47*b* however are displaceable in a transverse direction with respect to the central part 46 and, in the narrow condition of the ski, directly laterally adjoin the central portion 2 at the outside thereof.

For increasing the width of the ski the edge portions 48*a* and 48*b* are moved laterally outwardly so that formed between the edge portions 48*a* and 48*b* and the central portion 2 is a spacing which is then closed downwardly by subsequent downward movement of the side portions 6*a* and 6*b* with respect to the center part 46, so that the undersides as sole surfaces both of the central portion 2 and also the laterally adjoining side portions 6*a* and 6*b* and the edge portions 48*a* and 48*b* which are in turn in laterally adjoining relationship in an outward direction are at the same level.

As described with reference to FIGS. 1*b* and 1*c,* the increases in width which have been described hereinbefore with reference to FIGS. 6 through 12 can again, as in the case of FIG. 1*a,* take place uniformly over the entire length of the ski, or they can be non-uniform, for example by outward pivotal movement about vertical pivot axes 16*a* and 16*b* so that the increase in width takes place for example only in a front region and a tail region of the ski, but not in the central region.

Looking back now at FIG. 7, shown therein is a structure in which the increase in width of the sliding runner in the form of a ski is effected by lateral extension of side portions 6*a* and 6*b* which are not disposed at the same level as the downwardly disposed central portion on which the ski moves when in the narrow condition, but at a higher level than same.

In the narrow condition of the ski therefore, as shown in FIG. 7*a,* the user skis exclusively on the sole surface 12 of the central portion 2, which is continuous in the transverse direction of the ski. Edge portions 13 for edging control of the ski are also disposed in the usual way along the lower outside edges of the central portion 2.

Arranged on the top side of the central portion 2 in mutually juxtaposed relationship are the side portions 6*a* and 6*b* which, in the narrow condition of the ski, do not project laterally beyond the central portion 2 or project laterally therebeyond only to an immaterial degree. The side portions 6*a* and 6*b* are held on the top side of the central portion 2 by means of a guide portion indicated at 39 in order to prevent them from lifting away therefrom. The guide portion 32 can be for example of a generally T-shaped cross-section.

By virtue of outward sliding movement of the side portions 6*a* and 6*b* into the wide condition of the ski, as shown in FIG. 7*b,* the outside edges of the side portions 6*a* and 6*b* project laterally outwardly in a transverse direction 11 beyond the central portion 2. If the direction of displacement, as illustrated in the case of the structure shown in FIG. 7*a,* is approximately parallel to the underside of the central portion 2, that is to say the sole surface 12 thereof, then in the outwardly extended condition the downwardly directed sliding surfaces of the side portions 6*a* and 6*b* are disposed above the plane of the sole surface 12 of the central portion 2, by an amount corresponding to the thickness of the latter. That however is not a matter of disadvantage in relatively loose snow for which in fact the increase in width of the ski is often more particularly intended.

The guide portion 39 projects outwardly to such an extent that, even in the outwardly extended limit condition of the side portions 6*a* and 6*b,* the guide portion 39 still engages over the side portions and presses them sufficiently firmly against the top side of the central portion 2.

As shown in FIG. 7*b,* the displacement direction 41 of the side portions 6*a* and 6*b* may however also be directed inclinedly outwardly and downwardly with respect to the horizontal, that is to say the plane of the sole surface 12 of the central portion 2. An angle of just a few degrees, for example between 3 and 15°, preferably 5 and 10°, is adequate for that purpose. That provides that, when the side portion for example 6*b* is displaced outwardly, its sole surface 12*b* in the widened condition of the ski is not above the level of the sole surface 12 of the central portion 2 or is only slightly above that level.

Figure 10A:
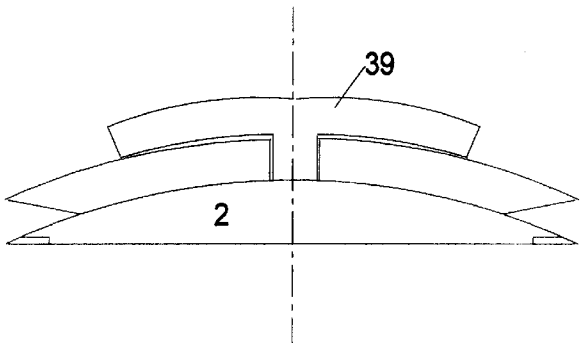
FIGS. 10*a* and 10*b* show views in cross-section of a ski in a narrow condition and in a wide condition in yet another structure.
Figure 10B:
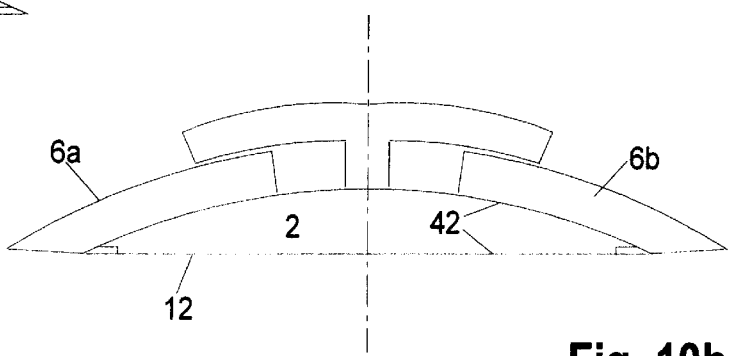

The structures shown in FIGS. 10 and 12 represent modifications of the structure shown in FIGS. 7*a* and 7*b*. In the FIG. 10 embodiment the displacement direction of the side portions 6*a* and 6*b* which are guided on the top side of the central portion 2 is an arcuate contour and the guide surfaces on the top side of the central portion 2 and the underside of the guide portion 39 are also correspondingly arcuate. As in FIGS. 7*a* and 7*b* the side portions 6*a* and 6*b* are preferably of a thickness which remains the same over their transverse extent.

The structure shown in FIG. 10 affords the advantage that the laterally outwardly disposed edge regions of the central portion 2, by virtue of the arcuate top side, are less convergent outwardly in a point and are thus stronger and more robust.

The width of the sole surface 12*a* and 12*b* of the side portions is accordingly determined by two factors.

Firstly, the width of the sole surfaces 12*a* and 12*b* increases, in proportion to increasing thickness of the side portions 6*a* and 6*b*.

On the other hand, the width of the sole surfaces 12*a* and 12*b* also increases in proportion to an increasing angle 42 at which the arcuate top side of the central portion 2 meets the underneath sole surface 12 thereof. That angle depends not only on the preferably uniform radius of curvature of the top side of the central portion 2, but also the width of the latter.

In the case also of these arcuately curved side portions 6*a* and 6*b,* instead of being prevented from lifting away from the central portion 2 by means of the upper guide portion 39 secured to the central portion 2, the side portions can also be guided by means of a guide configuration 33*a,* 33*b,* 33*c* which affords positively locking engagement, for example a guide configuration of dovetail shape, thereby eliminating the need for the guide portion 39.

Figure 12A:
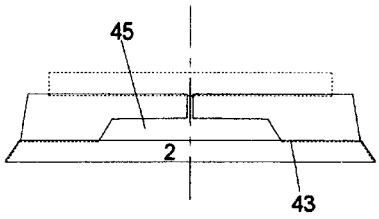
FIGS. 12*a* and 12*b* show views in cross-section of a ski in a narrow condition and in a wide condition in yet another structure.
Figure 12B:
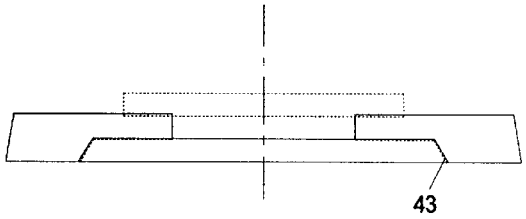

The structure shown in FIGS. 12*a* and 12*b* differs from that shown in FIG. 7, like the structure shown in FIGS. 9*a* and 9*b* differs from that shown in FIGS. 8*a* and 8*b*. In FIG. 12 also the side portions 6*a* and 6*b,* in the narrow condition of the ski, are disposed above the central portion 2 which is the only part of the ski on which a skier will ski when the ski is in the narrow condition. The outward and downward movement and thus lateral increase in width of the central portion 2 by the side portions 6*a* and 6*b* until the sole surfaces 12*a* and 12*b* of the latter are preferably disposed in one plane with the sole surface 12 of the central portion 2 does not take place in this case along a continuous displacement direction 41 as in FIGS. 7*a* and 7*b*.

As in the FIGS. 9*a* and 9*b* structure, the oppositely directed contact surfaces of the central portion 2 and the side portions 6*a* and 6*b* are of a two-stage configuration in respect of height and are horizontally displaced therebetween. When the ski is in the widened condition, the side portions are in the mutually remote position so that the central portion 2 which is of preferably trapezoidal cross-section is disposed in the spacing between the side portions in the lower half in terms of height of the ski.

When the ski is in the narrow condition the side portions 6*a* and 6*b* firstly slide upwardly along the inclined surface configuration of the central portion and then further horizontally inwardly along the top side of the trapezoidal central portion 2 until the side portions 6*a* and 6*b* are almost in contact with each other at the center, in their upper heightwise region.

In order to alter the ski from the narrow to the wide condition, the side portions must therefore firstly be moved horizontally outwardly with respect to the central portion and then downwardly, preferably along the lateral outside inclined surface configurations inclinedly downwardly and outwardly. That can be effected either by means of an active movement produced by a suitable mechanism, as described for example with reference to FIGS. 9*a* and 9*b,* or that can be implemented by a suitable positively locking guide action between the central portion and the respective side portion, for example with a guide configuration of dovetail shape.

Thus for example only the corner point 43 of the cross-section, which is at the lowest level and which faces towards the center, that is to say the downwardly and outwardly disposed end point of the corresponding inclined surface configuration of the respective side portion, can run in a suitable curve guide 44 which on the one hand extends along the outwardly inclinedly falling inclined surface configuration of the central portion and on the other hand along the outer region of the top side 45 of the central portion 2. By virtue of guidance of only one point of the side portions on the central portion 2, the guide means 44 on the central portion 2 can also have a varying radius of bending and also a kink.

In addition, in an alternative similar modification, such a curve guide means could be provided on the side portions 6*a* and 6*b,* with only a single point of the cross-section of the central portion 2 being guided therein.

In a further embodiment of the invention the winter sports device may include means for adjustment in respect of width, for example of a ski, whereby such adjustment takes place automatically, in particular for example in dependence on the structure and more particularly the hardness of the ground surface.

Furthermore, the ski can be prestressed, for example by means of spring force, into its wider condition, wherein the prestressing force is so directed that the variation in width of the ski in the direction of a narrow condition is achieved by tilting the ski on edge, that is to say with increased inclined positioning of the sole surface 12 of the central part 2 with respect to the ground surface.

It will be appreciated that the above-described embodiments of the invention have been set forth solely by way of example and illustration of the principles thereof and that various other modifications and alterations may be made therein without thereby departing from the spirit and scope of the invention.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A winter sports device comprising at least one elongate sliding runner, and means for varying at least in part a configurational parameter of the sliding runner in a transverse direction relative to the longitudinal direction of the sliding runner, wherein the sliding runner includes a central part and a further part; and motion means for moving said further part in a transverse direction with respect to the central part and for fixing said further part.

2. A winter sports device as set forth in claim 1, wherein said configurational parameter is the width of the sliding runner.

3. A device as set forth in claim 2, wherein said means for varying the width of the sliding runner is operable only in at least one of the front and the rear parts of the sliding runner, with the central region being invariable in respect of width.

4. A device as set forth in claim 3 including rotational axes at the front and rear ends of the central region thereby to permit the variation in width in at least one of the front and rear regions by virtue of rotational movement therearound.

5. A device as set forth in claim 4, wherein the rotational axes are movable in the transverse direction.

6. A winter sports device as set forth in claim 1, wherein said configurational parameter of the sliding runner is waisting of the sliding runner.

7. A device as set forth in claim 1, further including means for varying said further part and said central part with respect to each other in their relative positions.

8. A device as set forth in claim 7 including a flexible sealing means for closing downwardly a gap which occurs when the parts are moved away from each other in the condition of being moved apart.

9. A device as set forth in claim 8, wherein the sealing means is a component of the sliding runner sole surface in the condition of being moved apart.

10. A device as set forth in claim 4, wherein said varying means include means for pivoting the further part relative to the central part about at least one pivot axis.

11. A device as set forth in claim 4, wherein the further part includes at least one side part and in a narrow condition of the sliding runner the further part is pivoted upwardly with respect to the central part and is out of operation whereby the edges of the central part are used for moving on the sliding runner.

12. A device as set forth in claim 7 including means for positioning said parts such that both in the wide and in the narrow condition of the sliding runner the running surfaces of all individual parts jointly form the sole surface but the angular positioning of the individual parts relative to each other is altered between the wide condition and the narrow condition, wherein the wide condition the individual parts afford a mutually aligned sole surface which is at least substantially flat in the transverse direction of the sliding runner.

13. A device as set forth in claim 12 including fixing members for setting and fixing the angular position of the individual parts relative to each other as viewed in the longitudinal direction.

14. A device as set forth in claim 13, wherein said fixing members are intermediate wedge members which are adapted to be inserted between the individual parts for fixing same and which optionally have projecting arm portions.

15. A device as set forth in claim 7 including fluid-operated means for moving the individual parts between the wide and the narrow conditions.

16. A device as set forth in claim 1, wherein said motion means includes at least one adjusting screw for implementing said movement.

17. A device as set forth in claim 1, wherein said screw is self-locking.

18. A device as set forth in claim 1, wherein the sliding runner is of a one-part structure in its width and is variable in respect of its width by virtue of inherent elasticity.

19. A device as set forth in claim 18 including mechanical means for varying said width.

20. A device as set forth in claim 18 including fluid-operated means for varying said width.

21. A device as set forth in claim 18, wherein in cross-section the sliding runner is of a corrugated or zig-zag profile, and including means for expanding the sliding runner in the transverse direction into the wide condition.

22. A device as set forth in claim 1 and comprising first and second further parts as side parts, wherein in the narrow condition of the sliding runner the side parts form the sole surface of the ski.

23. A device as set forth in claim 1 and comprising first and second further parts as side parts, wherein the sliding runner is a ski and in the narrow condition of the ski the central part forms the sole surface of the ski and the side parts are above the central part.

24. A device as set forth in claim 23 including means for producing a lateral outward movement of the side parts for the purposes of increasing the width of the ski and also for lowering the side parts until their sole surfaces are at the level of the sole surface of the central part.

25. A device as set forth in claim 1, including guide means for the relative movement between the central part and the further part, the guide means extending transversely with respect to the longitudinal direction of the sliding runner and in particular affording a positively locking relationship.

26. A device as set forth in claim 25, wherein the guide means is of dovetail cross-section.

27. A device as set forth in claim 1 comprising means for adjustment in respect of width of the ski automatically, in dependence on the structure and hardness of the ground.

28. A device as set forth in claim 1, wherein the ski is prestressed by means of spring force towards its wider condition, and said prestressing force is so directed that the variation in the width of the ski in the direction of a narrow condition is achieved by tilting the ski on edge involving increased inclined positioning of the sole surface of the ski with respect to the ground surface.

* * * * *